US010643638B2

(12) United States Patent
Nariyama et al.

(10) Patent No.: US 10,643,638 B2
(45) Date of Patent: May 5, 2020

(54) TECHNIQUE DETERMINATION DEVICE AND RECORDING MEDIUM

(71) Applicant: Yamaha Corporation, Hamamatsu-shi, Shizuoka (JP)

(72) Inventors: Ryuichi Nariyama, Hamamatsu (JP); Shuichi Matsumoto, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 158 days.

(21) Appl. No.: 15/989,514

(22) Filed: May 25, 2018

(65) Prior Publication Data

US 2018/0277144 A1 Sep. 27, 2018

Related U.S. Application Data

(63) Continuation of application No. PCT/JP2016/084945, filed on Nov. 25, 2016.

(30) Foreign Application Priority Data

Nov. 27, 2015 (JP) ..... 2015-231562

(51) Int. Cl.
*G10L 25/60* (2013.01)
*G10L 25/21* (2013.01)
(Continued)

(52) U.S. Cl.
CPC ..... *G10L 25/60* (2013.01); *G10H 1/0008* (2013.01); *G10H 1/361* (2013.01); *G10L 25/21* (2013.01);
(Continued)

(58) Field of Classification Search
CPC ..... G10L 25/60; G10L 25/21; G10L 25/90; G10L 25/51; G10H 1/0008; G10H 1/361;
(Continued)

(56) References Cited

U.S. PATENT DOCUMENTS 5,804,752 A * 9/1998 Sone ..... G10H 1/361 84/610
2011/0209596 A1 9/2011 Mestres et al.
2015/0262017 A1* 9/2015 Oguchi ..... G06F 16/7834 382/190

FOREIGN PATENT DOCUMENTS

JP 2005-107335 A 4/2005
JP 2006-31041 A 2/2006
(Continued)

OTHER PUBLICATIONS

English translation of document C2 (Japanese-language Written Opinion (PCT/ISA/237) previously filed on May 25, 2018) issued in PCT Application No. PCT/JP2016/084945 dated Jan. 31, 2017 (five (5) pages).
(Continued)

*Primary Examiner* — Sonia L Gay
(74) *Attorney, Agent, or Firm* — Crowell & Moring LLP

(57) ABSTRACT

A technique determination device according to one embodiment of the present invention comprises an input sound acquisition unit acquiring an input sound, a pitch detection unit detecting a pitch on a time-series basis based on the input sound, a sound-volume detection unit detecting a sound volume on the time series basis based on the input sound, a first starting-point detection unit determining whether variation of the sound volume is equal to or larger than a predetermined threshold for each predetermined period and detecting a starting point of a period in which the variation of the sound volume is equal to or larger than the threshold as a first starting point, and a technique determination unit determining a technique of the input sound based on a change of the sound volume after the first starting point and variation of the pitch after the first starting point.

20 Claims, 10 Drawing Sheets

(51) Int. Cl.

| | |
|---|---|
| ***G10L 25/90*** | (2013.01) |
| ***G10L 25/51*** | (2013.01) |
| ***G10H 1/00*** | (2006.01) |
| ***G10H 1/36*** | (2006.01) |

(52) U.S. Cl.
CPC ..... *G10L 25/90* (2013.01); *G10H 2210/066* (2013.01); *G10H 2210/091* (2013.01); *G10H 2220/011* (2013.01); *G10H 2250/025* (2013.01); *G10L 25/51* (2013.01)

(58) Field of Classification Search
CPC ..... G10H 2210/066; G10H 2210/091; G10H 2220/011; G10H 2250/025
See application file for complete search history.

(56) References Cited

FOREIGN PATENT DOCUMENTS

| | | | | |
|---|---|---|---|---|
| JP | 2007232750 | A | * | 9/2007 |
| JP | 2008-26622 | A | | 2/2008 |
| JP | 2013-213907 | A | | 10/2013 |
| JP | 2014-92550 | A | | 5/2014 |

OTHER PUBLICATIONS

International Search Report (PCT/ISA/210) issued in PCT Application No. PCT/JP2016/084945 dated Jan. 31, 2017 with English translation (five pages).
Japanese-language Written Opinion (PCT/ISA/237) issued in PCT Application No. PCT/JP2016/084945 dated Jan. 31, 2017 (four pages).

* cited by examiner

TECHNIQUE DETERMINATION DEVICE AND RECORDING MEDIUM

CROSS REFERENCE TO RELATED APPLICATIONS

This application is based on and claims the benefit of priority from the prior Japanese Patent Application No. 2015-231562, filed on Nov. 27, 2015 and the prior PCT Application PCT/JP2016/084945, filed on Nov. 25, 2016, the entire contents of which are incorporated herein by reference.

FIELD

The present invention relates to a technology of determining a technique of an input sound.

BACKGROUND

Karaoke devices include a function of analyzing and evaluating a singing voice. For evaluation of singing, various methods are used. As one of these methods, for example, Japanese Patent Application Laid-Open No. 2006-31041 discloses a karaoke device which grades singing by grading different musical elements such as frequencies (tones), sound volumes, and so forth respectively and calculating a total score based on these grading results.

SUMMARY

According to one embodiment of the present invention, a technique determination device is provided which includes an input sound acquisition unit which acquires an input sound, a pitch detection unit which detects a pitch on a time-series basis based on the input sound acquired by the input sound acquisition unit, a sound-volume detection unit which detects a sound volume on a time-series basis based on the input sound acquired by the input sound acquisition unit, a first starting-point detection unit which determines whether variation of the sound volume detected by the sound-volume detection unit is equal to or larger than a predetermined threshold for each predetermined period and detects a starting point of a period in which the variation of the sound volume is equal to or larger than the threshold as a first starting point, and a technique determination unit which determines a technique of the input sound based on a change of the sound volume after the first starting point detected by the first starting-point detection unit and variation of the pitch after the first starting point.

According to one embodiment of the present invention, a program is provided for causing a computer to execute processes including acquiring an input sound, detecting a pitch on a time-series basis based on the input sound, detecting a sound volume on a time-series basis based on the input sound, determining whether variation of the detected sound volume is equal to or larger than a predetermined threshold for each predetermined period, detecting a starting point of a period in which the variation of the sound volume is equal to or larger than the threshold as a first starting point, and determining a technique of the input sound based on a change of the sound volume after the detected first starting point and variation of the pitch after the first starting point.

DESCRIPTION OF EMBODIMENTS

Karaoke devices detect and evaluate a characteristic singing portion as a technique. However, there is a problem that there are techniques which cannot be detected by conventional karaoke devices because there are various techniques in singing.

In the following, technique determination devices in embodiments of the present invention is described in detail with reference to the drawings. The following embodiments described below are merely examples of the embodiment of the present invention, and the present invention is not restricted by these embodiments.

First Embodiment

A technique determination device in a first embodiment of the present invention is described in detail with reference to the drawings. The technique determination device according to the first embodiment is a device including a function of determining a singing sound of a singing user (which may be hereinafter referred to as a singer). This technique determination device detects a pitch and a sound volume of a singing sounds on a time-series basis, and determines a specific technique based on a change of the sound volume and variation of the pitch.

[Hardware]

Figure 1:
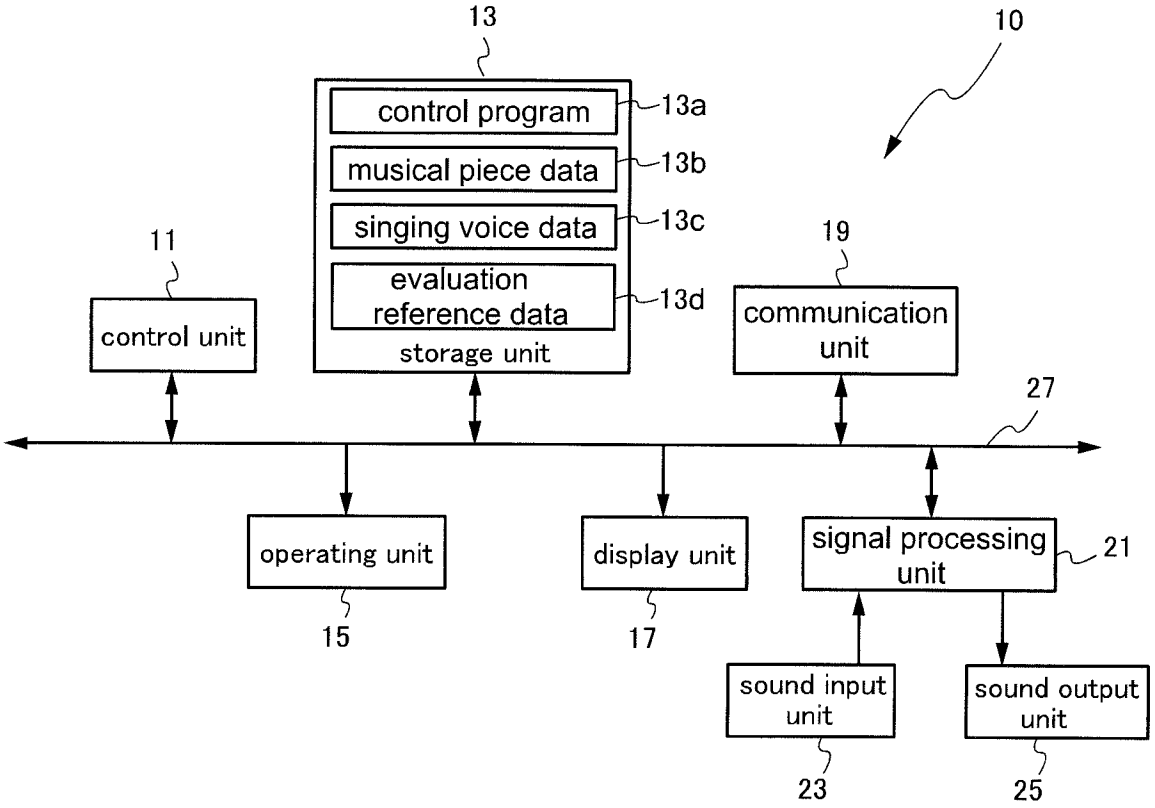
FIG. 1 is a block diagram showing the structure of a technique determination device 1 according to one embodiment of the present invention.

FIG. 1 is a block diagram showing the structure of a technique determination device 10 in the first embodiment of the present invention. The technique determination device 10 is, for example, a karaoke device including a singing grading function. The technique determination device 10 includes a control unit 11, a storage unit 13, an operating unit 15, a display unit 17, a communication unit 19, and a signal processing unit 21. A sound input unit (for example, microphone) 23 and a sound output unit (for example, loudspeaker) 25 are connected to the signal processing unit 21. These structures are mutually connected via a bus.

The control unit 11 includes an arithmetic processing circuit such as a CPU. The control unit 11 executes, by the CPU, a control program 13*a* stored in the storage unit 13 to achieve various functions on the technique determination device 10. Functions to be realized include a singing technique determination function. Also, the functions to be realized may include a singing evaluation function based on the technique determined by technique determination.

The storage unit 13 is a storage device such as a non-volatile memory or hard disk. The storage unit 13 stores the control program 13*a* for achieving the technique determination function. The control program 13*a* may include a singing evaluation function. The control program 13*a* may be provided in a state of being stored in a computer-readable recording medium such as a magnetic recording medium, an optical recording medium, a photomagnetic recording medium, or a semiconductor memory. In this case, the technique determination device 10 is only required to include a device which reads a recording medium. Also, the control program 13*a* may be downloaded via a network such as the Internet.

Also, the storage unit 13 stores musical piece data 13*b* and singing voice data 13*c* as data regarding singing. Also, the storage unit 13 may store evaluation reference data 13*d*. The musical piece data 13*b* includes data related to karaoke songs, for example, guide melody data, accompaniment data, and lyrics data, and so forth. The guide melody data is data indicating melodies of songs. The accompaniment data is data indicating accompaniments of songs. The guide melody data and the accompaniment data may be data represented in MIDI format. The lyrics data is data for causing lyrics of songs to be displayed and data indicating timings of changing the color of a displayed lyrics telop. The singing voice data 13*c* is data corresponding to a singing voice inputted by the singer to the sound input unit 23. In the present embodiment, the singing voice data 13*c* is stored in the storage unit 13 until a singing voice is determined by the technique determination function. The evaluation reference data 13*d* is information for use by the evaluation function as a reference of evaluation of a singing voice, and may be reference sound data associated in advance to musical piece data indicating a song to be evaluated (song being outputted when a singing voice is inputted).

The operating unit 15 is a device such as an operation button provided to an operation panel and a remote controller, a keyboard, and a mouse, outputting a signal in accordance with an input operation to the control unit 11. The display unit 17 is a display device such as a liquid-crystal display, an organic EL display, and so forth, where a screen based on the control by the control unit 11 is displayed. Note that a touch panel device with the operating unit 15 and the display unit 17 integrated together may be used. The communication unit 19 is connected to a communication line such as the Internet or LAN based on the control by the control unit 11 to transmit and receive information to and from an external device such as a server. Note that the functions of the storage unit 13 may be realized by an external device capable of communicating with the communication unit 19.

The signal processing unit 21 includes a sound source which generates an audio signal from a signal in MIDI format, an A/D converter, a D/A converter, and so forth. The singing voice is converted by the sound input unit 23 into an electric signal, which is inputted to the signal processing unit 21. In the signal processing unit 21, the signal is subjected to A/D conversion, and is outputted to the control unit 11. The singing voice is stored in the storage unit 13 as the singing voice data 13*c*. Also, the accompaniment data is read by the control unit 11, is subjected to D/A conversion in the signal processing unit 21, and is outputted from the sound output unit 25 as an accompaniment of the song. Here, a guide melody may be outputted from the sound output unit 25.

[Technique Determination Function]

Described is a technique determination function realized by the control unit 11 of the technique determination device 10 executing the control program 13*a* stored in the storage unit 13. Note that a part or an entire of structures achieving the technique determination function described below may be realized by hardware.

Figure 2:
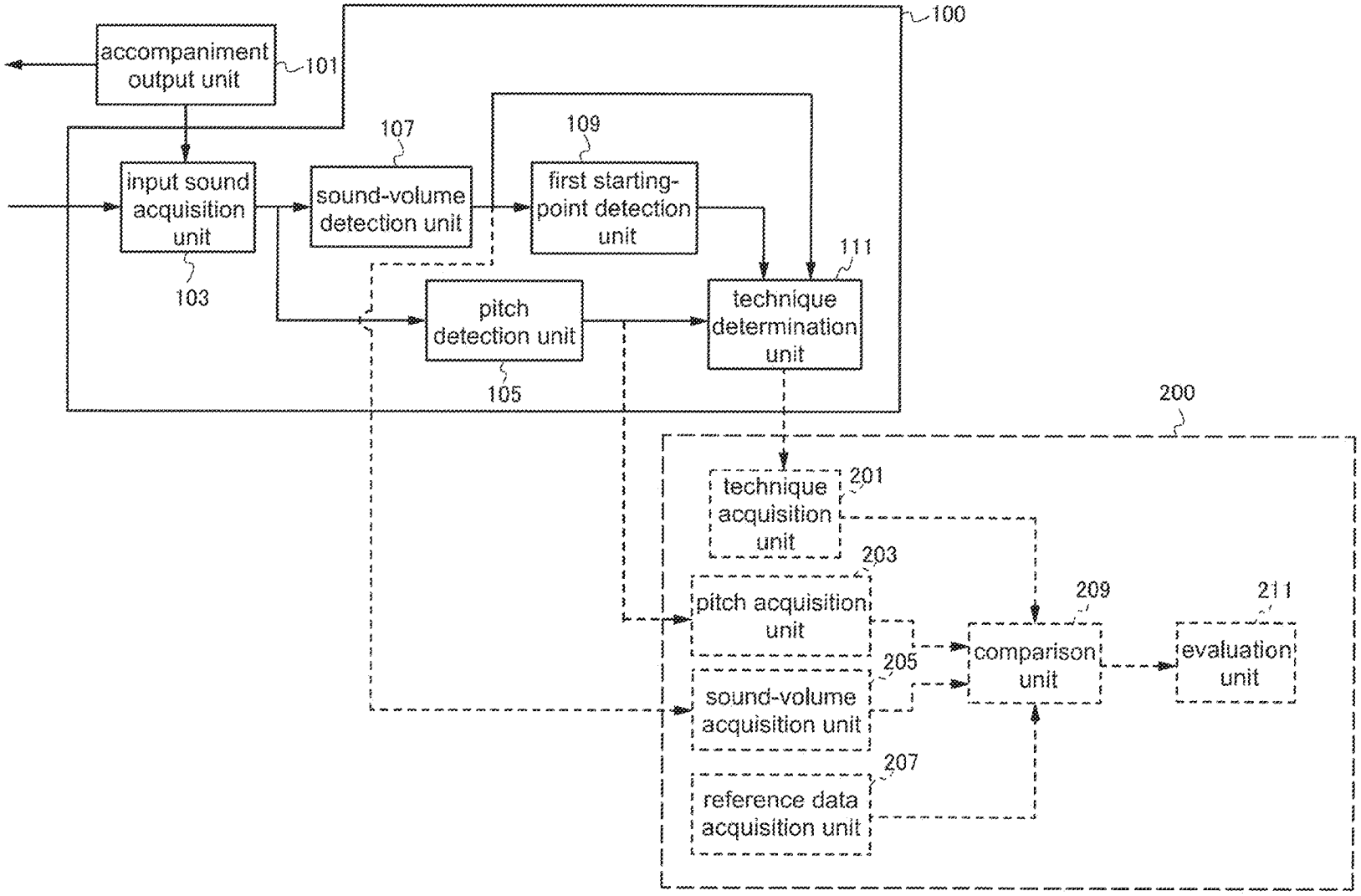
FIG. 2 is a block diagram showing the structure of a technique determination function and an evaluation function in one embodiment of the present invention.

FIG. 2 is a block diagram showing the structure of the technique determination function 100 of the first embodiment of the present invention. With reference to FIG. 2, the technique determination function 100 includes an input sound acquisition unit 103, a pitch detection unit 105, a sound-volume detection unit 107, a starting-point detection unit 109, and a technique determination unit 111.

The input sound acquisition unit 103 acquires singing voice data (input sound) corresponding to the singing voice inputted to the sound input unit 23. Note that the input sound acquisition unit 103 acquires the singing voice data directly from the signal processing unit 21, but may acquire the singing voice data once stored in the storage unit 13. Also, the input sound acquisition unit 103 is not limited to acquire singing voice data indicating an input sound to the sound input unit 23, and may acquire, by the communication unit 19, singing voice data indicating an input sound to the external device via a network. In the present embodiment, the input sound acquisition unit 103 sequentially outputs the singing voice data sequentially inputted during replay of the musical piece data.

The pitch detection unit 105 detects a pitch of a singing sound on a time-series basis based on the singing voice data acquired by the input sound acquisition unit 103. That is, the pitch detection unit 105 detects, for each frame (each of data samples sectioned by a predetermined period), a zero cross when a waveform of a voice signal indicated by the singing voice data changes from negative to positive, and measures a time interval between these zero crosses, to specify a pitch (frequency) of the singing sound. Here, from this voice signal, a high-frequency component as a noise component may be cut by a low-pass filter or a direct-current component may be cut by a high-pass filter. Also, the pitch detection unit 105 may specify a pitch from a spectrum acquired by performing FFT (Fast Fourier Transform) on the singing voice data. The pitch detection unit 105 outputs information indicating the pitch detected in the above-described manner to the technique determination unit 111 on the time-series basis.

The sound-volume detection unit 107 detects a sound volume of the singing sound on the time-series basis based on the singing voice data acquired by the input sound acquisition unit 103. The sound-volume detection unit 107 detects a temporal change of the sound volume (sound-volume waveform) of the singing sound based on the singing voice data. In the present embodiment, the sound-volume detection unit 107 detects a sound volume based on the amplitude of the voice signal indicated by the singing voice data. The sound-volume detection unit 107 outputs data indicating the detected sound volume to the starting-point detection unit 109 on the time-series basis.

The starting-point detection unit 109 determines whether variation of the sound volume is equal to or larger than a predetermined threshold $\Delta Vth$ for each frame (each of data samples sectioned by a predetermined period) based on the data indicating the sound volume detected by the sound-volume detection unit 107. When a predetermined number of frames or more (for example, two or more frames) in which variation of the sound volume is equal to or larger than the predetermined threshold ΔVth are continuously detected, the starting-point detection unit 109 identifies the plurality of frames in which variation of the sound volume is equal to or larger than the predetermined threshold ΔVth as a sound-volume change period, and detects a starting point of the first frame in the plurality of frames configuring the sound-volume change period as a starting point (first starting point) of the sound-volume change. The starting-point detection unit 109 outputs data indicating the detected starting point of the sound-volume change to the technique determination unit 111.

The technique determination function 100 may include an accompaniment output unit 101 which reads accompaniment data corresponding to a song specified by the singer and causes an accompaniment sound to be outputted from the sound output unit 25 via the signal processing unit 21. In this case, an input sound to the sound input unit 23 in a period during which the accompaniment sound is being outputted is recognized as a singing voice to be determined.

Figure 3:
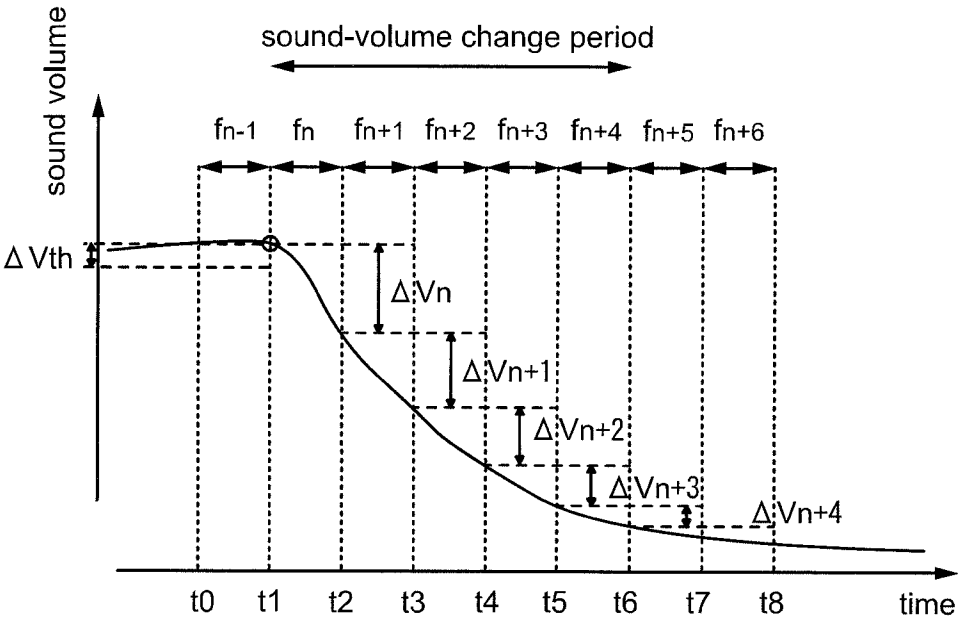
FIG. 3 is a diagram for describing a concept of detection of a first starting point in one embodiment of the present invention.

FIG. 3 is a diagram for describing a concept of detection of a starting point executed by the starting-point detection unit 109. FIG. 3 shows a sound volume waveform indicating a sound volume of a singing sound on a time-series base, with the vertical axis representing sound volume (V) and the horizontal axis representing time (T). In FIG. 3, frames $f_{n-1}$ to $f_{n+6}$ are shown. The length of a frame f is arbitrary. The starting-point detection unit 109 determines whether variation of the sound volume in each of the frames $f_{n-1}$ to $f_{n+6}$ is equal to or larger than the predetermined threshold ΔVth. For example, when variation of the sound volume in each of the frames $f_n$, $f_{n+1}$, $f_{n+2}$, $f_{n+3}$, and $f_{n+4}$ is equal to or larger than the predetermined threshold ΔVth (ΔVn≥ΔVth, ΔVn+1≥ΔVth, ΔVn+2≥ΔVth, ΔVn+3≥ΔVth, and ΔVn+4≥ΔVth), the starting-point detection unit 109 identifies the frames $f_n$ to $f_{n+4}$, that is, a starting point t1 of the frame $f_n$ to an ending point t6 of the frame $f_{n+4}$, as a sound-volume change period. The starting-point detection unit 109 detects the starting point t1 of the frame $f_n$ which is an initial frame among the frames $f_n$ to $f_{n+4}$ forming the sound-volume change period as a starting point of sound-volume change (first starting point).

The technique determination unit 111 determines a technique of a singing voice based on a change in sound volume after the first starting point t1 (starting point of sound-volume change) detected by the starting-point detection unit 109 and variation of the pitch after the starting point of sound-volume change. For example, the technique determination unit 111 determines vibration and down (Nuki), vibrato, crescendo, and decrescendo as a singing technique.

Figure 4:
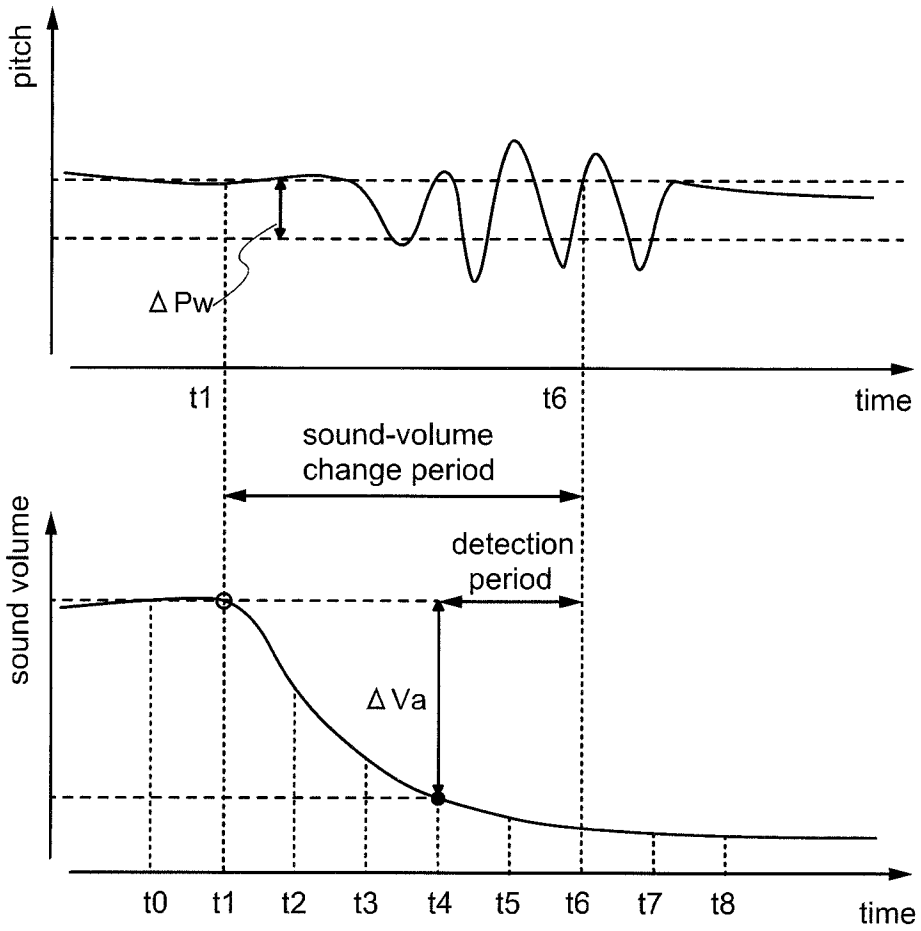
FIG. 4 is a diagram for describing a concept of vibration and down determination in one embodiment of the present invention.

FIG. 4 shows diagrams for describing a concept of vibration and down (Nuki) determination executed by the technique determination unit 111. Vibration and down (Nuki) is a technique of vibrating a pitch with a decrease in sound volume. FIG. 4 shows one example of a pitch waveform and one example of a sound volume waveform of a singing sound. In the pitch waveform shown FIG. 4, the vertical axis represents pitch (P), and the horizontal axis represents time (T). In the sound volume waveform shown FIG. 4, the vertical axis represents sound volume (V), and the horizontal axis represents time (T). In FIG. 4, the pitch waveform and the sound volume waveform in the same period are shown on a time-series basis. In FIG. 4, the first starting point (starting point of sound-volume change) detected by the starting-point detection unit 109 is taken as t1, and a period from t1 to t6 is taken as the sound-volume change period. The technique determination unit 111 may define at least a part of a predetermined period in the sound-volume change period after the first starting point (starting point of sound-volume change) t1 as a detection section, and may determine that vibration and down (Nuki) is included in the singing sound after the first starting point t1 when the pitch vertically vibrates as exceeding a predetermined width (ΔPw) defined in advance in the detection section. The predetermined period (detection period) may be, for example, as shown in the sound volume waveform in FIG. 4, from a point t4 (starting point of the detection period) when a decrease in sound volume from the first starting point (sound-volume change starting point) t1 becomes equal to or larger than a predetermined value (ΔVa) to the ending point t6 of the sound-volume change period. When the pitch vertically vibrates as exceeding the predetermined width (ΔPw) defined in advance in the detection period from t4 to t6, the technique determination unit 111 may determine that vibration and down (Nuki) is included in the singing sound after the first starting point t1. Note that the setting of the detection period is not limited to the example described above.

The detection period is only required to be at least a predetermined partial period in the sound-volume change period after the first starting point t1 as described above, and the entire period (t1 to t6) of the sound-volume change period may be set as a detection period. When the technique determination unit 111 determines vibration and down (Nuki) included in the singing sound, the technique determination unit 111 may determine that vibration and down (Nuki) is included in the singing sound after the first starting point t1 if the pitch vertically vibrates as exceeding the predetermined width (ΔPw) defined in advance during a decrease of the sound volume after the first starting point t1, that is, in the sound-volume change period (period from t1 to t6). For example, if vibration of the pitch exceeding the predetermined width defined in advance is present in the entire period of the sound-volume change period, it may be determined that vibration and down (Nuki) is included in the singing sound after the first starting point t1.

Figure 5:
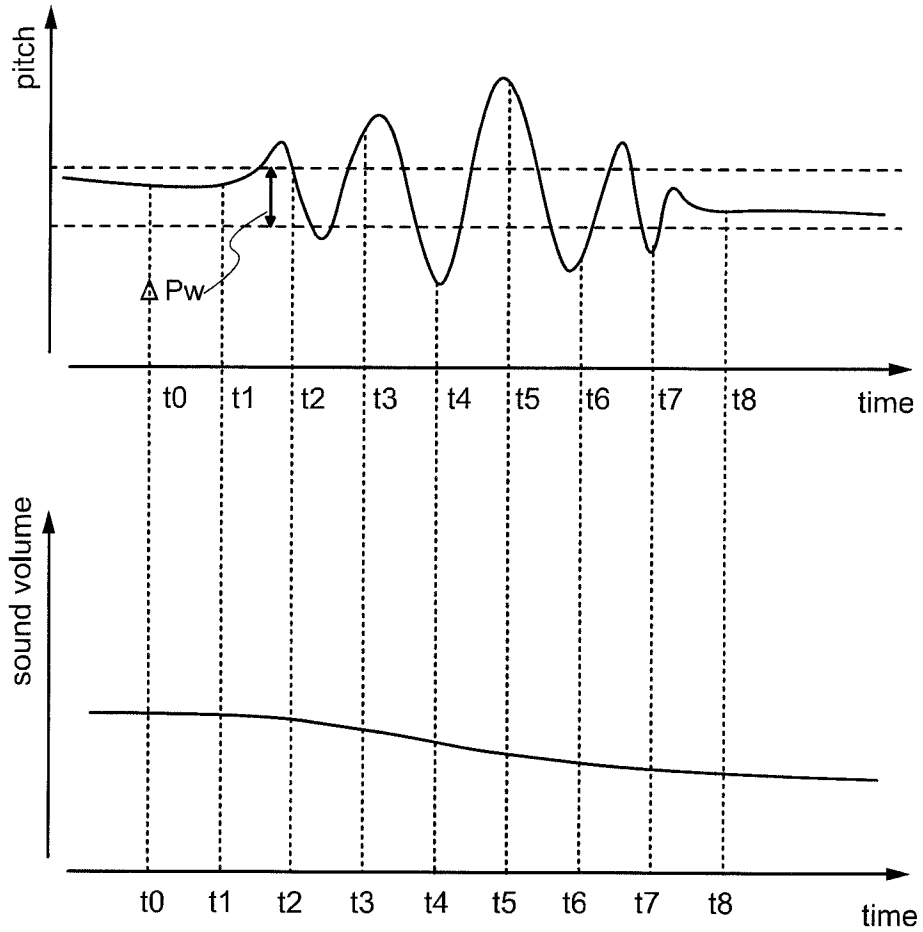
FIG. 5 is a diagram for describing a concept of vibrato determination in one embodiment of the present invention.

FIG. 5 shows diagrams for describing a concept of vibrato determination executed by the technique determination unit 111. Vibrato is a technique of mainly vibrating a pitch. FIG. 5 shows one example of a pitch waveform and one example of a sound volume waveform of a singing sound. In the pitch waveform shown in FIG. 5, the vertical axis represents pitch (P), and the horizontal axis represents time (T). In the sound volume waveform shown in FIG. 5, the vertical axis represents sound volume (V), and the horizontal axis represents time (T). In FIG. 5, the pitch waveform and the sound volume waveform in the same period are shown on a time-series basis. The sound volume waveform of the singing sound shown in FIG. 5 does not include a sound-volume change period. That is, FIG. 5 shows a sound volume waveform of the singing sound when a frame in which variation of the sound volume is equal to or larger than the predetermined threshold ΔVth is not detected from t0 to t8. As shown in FIG. 5, when the pitch periodically varies as exceeding the predetermined width (ΔPw) defined in advance in a period which is not the sound-volume change period, the technique determination unit 111 determines that variation of the pitch comes from vibrato and vibrato is included in the singing sound.

Note that while FIG. 5 shows the sound volume waveform of the singing sound in a period not including the sound-volume change period, vibrato may be accompanied by variation of the sound volume equal to or larger than the predetermined threshold ΔVth in synchronization with vibration of the pitch. That is, vibrato is not limited to periodical variation exceeding the predetermined width (ΔPw) of the pitch in a period which is not the sound-volume change period. In a sound-volume change period in which variation of the sound volume in synchronization with vibration of the pitch is present, when the pitch periodically varies as exceeding the predetermined width width (ΔPw) defined in advance, the technique determination unit 111 may determine that vibrato is included in the singing sound.

Figure 6:
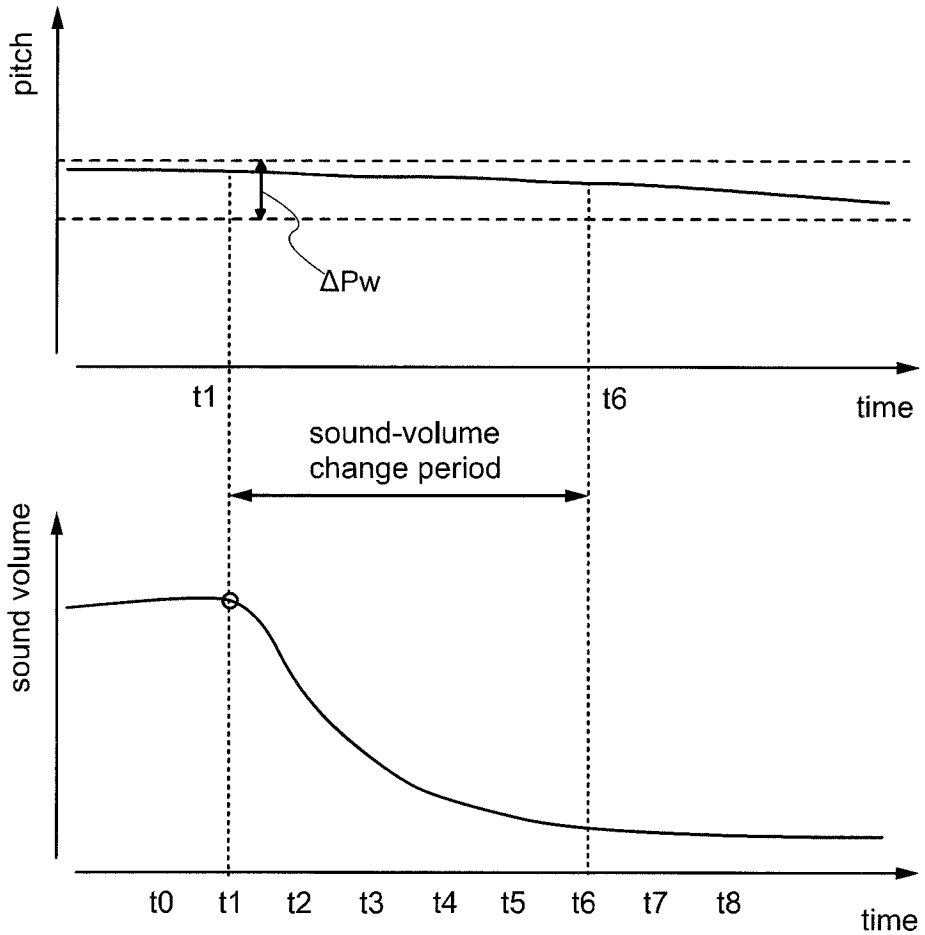
FIG. 6 is a diagram for describing a concept of decrescendo determination in one embodiment of the present invention.

FIG. 6 shows diagrams for describing a concept of decrescendo determination executed by the technique determination unit 111. FIG. 6 shows one example of a pitch waveform and one example of a sound volume waveform of a singing sound. In the pitch waveform shown in FIG. 6, the vertical axis represents pitch (P), and the horizontal axis represents time (T). In the sound volume waveform shown in FIG. 6, the vertical axis represents sound volume (V), and the horizontal axis represents time (T). In FIG. 6, the pitch waveform and the sound volume waveform in the same period are shown on a time-series basis. In FIG. 6, the first starting point (starting point of sound-volume change) detected by the starting-point detection unit 109 is taken as t1, and a period from t1 to t6 is taken as the sound-volume change period. As shown in FIG. 6, when the sound volume after the first starting point t1 decreases and periodical variation of the pitch exceeding the predetermined width (ΔPw) defined in advance is not present (variation of the pitch is not present) in the sound-volume change period after the first starting point t1, the technique determination unit 111 determines that decrescendo is included in the singing sound after the first starting point t1.

Figure 7:
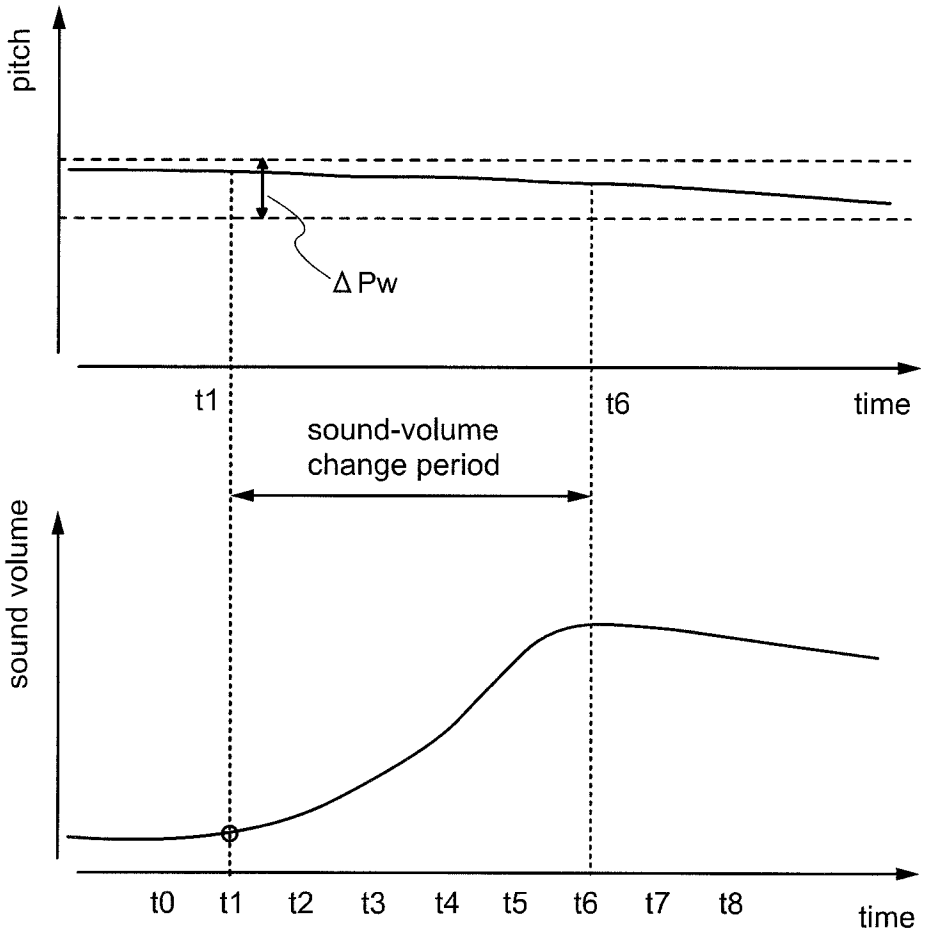
FIG. 7 is a diagram for describing a concept of crescendo determination in one embodiment of the present invention.

FIG. 7 shows diagrams for describing a concept of crescendo determination executed by the technique determination unit 111. FIG. 7 shows one example of a pitch waveform and one example of a sound volume waveform of a singing sound. In the pitch waveform shown in FIG. 7, the vertical axis represents pitch (P), and the horizontal axis represents time (T). In the sound volume waveform FIG. 7, the vertical axis represents sound volume (V), and the horizontal axis represents time (T). In FIG. 7, the pitch waveform and the sound volume waveform in the same period are shown on a time-series basis. In FIG. 7, the first starting point (starting point of sound-volume change) detected by the starting-point detection unit 109 is taken as t1, and a period from t1 to t6 is taken as the sound-volume change period. As shown in FIG. 7, when the sound volume after the first starting point t1 increases and periodical variation of the pitch exceeding the predetermined width (ΔPw) defined in advance is not present (variation of the pitch is not present) in the sound-volume change period after the first starting point t1, the technique determination unit 111 determines that crescendo is included in the singing sound after the first starting point t1.

As described above, the technique determination device 10 in the first embodiment detects a pitch and a sound volume on a time-series basis from inputted singing voice data, and determines a specific technique based on variation of the sound volume (change of the sound volume) and variation of the pitch, that is, based on a correlation between variation of the sound volume (change of the sound volume) and variation of the pitch. A series of processes from detection of a pitch and a sound volume to technique determination can be performed for each predetermined frame with a small amount of arithmetic operation, and thus accumulation of singing voice data and machine learning are not required. This allows a specific technique to be correctly determined on a real-time basis while reducing the amount of arithmetic operation.

Modification Example

While the embodiment of the present invention has been described above, the present invention is not limited to the above-described embodiment, and can be implemented in other various modes. Examples of other modes below are described.

First Modification Example

As a function to be realized by the technique determination device 10, in addition to the singing technique determination function 100 described above, a singing evaluation function based on the technique determined by technique determination may be included. In the following, an evaluation function 200 realized by the control unit 11 of the technique determination device 10 executing the control program 13*a* stored in the storage unit 13 is described. A part or an entire of structures achieving the evaluation function 200 may be realized by hardware.

In FIG. 2, together with the technique determination function 100, the evaluation function 200 performing evaluation of singing based on the technique determined by the technique determination function 100 is also shown. With reference to FIG. 2, the evaluation function 200 includes a technique acquisition unit 201, a pitch acquisition unit 203, a sound-volume acquisition unit 205, a reference data acquisition unit 207, a comparison unit 209, and an evaluation unit 211.

The technique acquisition unit 201 acquires data indicating the technique of the singing sound determined by the technique determination unit 111 in the technique determination function 100, and outputs the acquired data to the comparison unit 209. The pitch acquisition unit 203 acquires, on a time-series basis, data indicating the pitch detected by the pitch detection unit 105 in the technique determination function 100, and outputs the acquired data to the comparison unit 209. The sound-volume acquisition unit 205 acquires, on the time-series basis, data indicating the sound volume of the singing sound detected by the sound-volume detection unit 107 in the technique determination function 100, and outputs the acquired data to the comparison unit. The reference data acquisition unit 207 reads and acquires the evaluation reference data 13*d* corresponding to the singing sound stored in the storage unit 13, and outputs the acquired data to the comparison unit 209. Note that the evaluation reference data 13*d* is only required to indicate a sound as a reference of evaluation and thus may not necessarily indicate a voice as a good example of singing.

The comparison unit 209 compares the acquired data indicating the pitch of the singing sound, data indicating the sound volume of the singing sound, and data indicating the technique of the singing sound with the evaluation reference data 13*d* corresponding to the singing sound. The comparison unit 209 may compare the acquired data indicating the pitch of the singing sound and reference pitch data included in the evaluation reference data 13*d* on the time-series basis, may compare the acquired data indicating the sound volume of the singing sound and reference sound-volume data included in the evaluation reference data 13*d* on the time-series basis, or may compare the acquired data indicating the technique of the singing sound and reference singing technique data included in the evaluation reference data 13*d*. For example, regarding techniques such as vibration and down (Nuki) and vibrato, the comparison unit 209 may compare the acquired technique of the singing sound and a reference singing technique included in the evaluation reference data 13*d* for a standard deviation of frequencies, an average value of frequencies, an average value of amplitudes of pitches, a standard deviation of amplitudes of pitches, a tilt of a linear approximation straight line of amplitudes of pitches, and so forth. The comparison unit 209 outputs the comparison result to the evaluation unit 211.

The evaluation unit 211 calculates an evaluation value as an index of evaluation of a singing sound based on the comparison result outputted from the comparison unit 209. The evaluation unit 211 calculates a higher evaluation value as a degree of matching between data indicating a pitch of the singing sound by the singer, data indicating a sound volume of the singing sound, and data indicating a technique of the singing sound, and their corresponding evaluation reference data 13*d* of the singing sound is higher, and calculates a lower evaluation value as a degree of non-matching is higher. Also, as for a technique with a high degree of difficulty such as vibration and down (Nuki) or vibrato, when the degree of matching between the singing sound by the singer and the evaluation reference data 13*d* of the singing sound is high, the evaluation unit 211 may provide a weighted value. Note that when evaluating a technique in singing, the evaluation unit 211 do not have to compare the singing sound by the singer and the evaluation reference data 13*d*. For example, when a predetermined technique is detected in singing, the evaluation unit 211 may provide the weighted value to the evaluation value, irrespectively of the technique detection position on a time-series basis. The evaluation result by the evaluation unit 211 may be displayed on the display unit 17.

Second Modification Example

In the above-described embodiment, in the technique determination function 100, the technique determination unit 111 determines a vibration and down (Nuki) technique in the singing sound based on the presence or absence of variation of the pitch in the sound-volume change period after the first starting point (starting point of sound-volume change) detected by the starting-point detection unit 109. However, when a starting point of variation of the pitch in the sound-volume change period is detected as a second starting point and a difference between the first starting point (starting point of sound-volume change) and the second starting point (starting point of variation of the pitch) is within a range of a predetermined period, the technique determination unit 111 may determine that vibration and down (Nuki) is included in the singing sound in the sound-volume change period.

Figure 8:
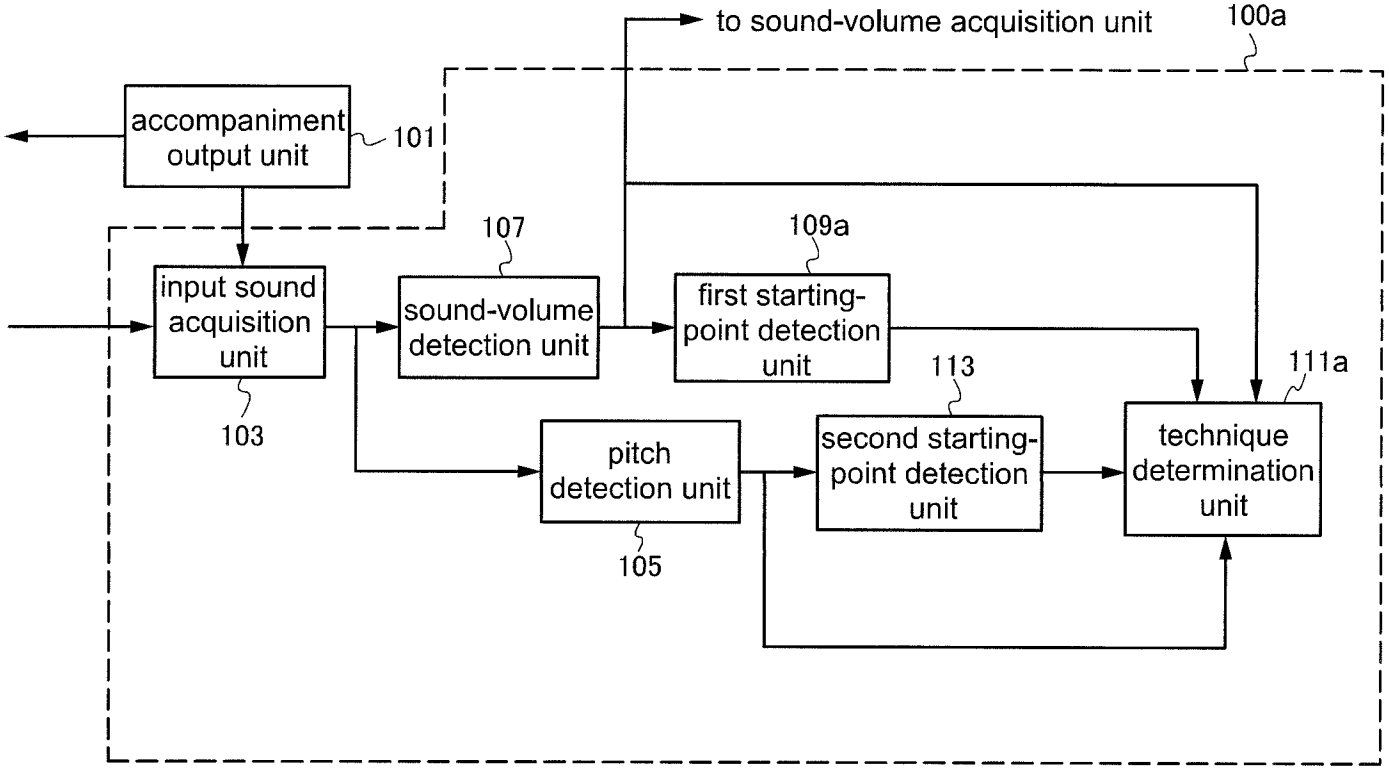
FIG. 8 is a block diagram showing a modification example of a technique determination function in one embodiment of the present invention.

FIG. 8 is a block diagram showing the structure of a technique determination function 100*a* in a modification example of the first embodiment of the present invention. With reference to FIG. 8, the technique determination function 100*a* includes the input sound acquisition unit 103, the pitch detection unit 105, the sound-volume detection unit 107, a first starting-point detection unit 109*a*, a technique determination unit 111*a*, and a second starting-point detection unit 113. The input sound acquisition unit 103, the pitch detection unit 105, and the sound-volume detection unit 107 in the technique determination function 100*a* are similar to those in the above-described technique determination function 100, and therefore their description is omitted. Also, the first starting-point detection unit 109*a* is similar to the starting-point detection unit 109 in the technique determination function 100 and therefore its description is omitted. The technique determination function 100*a* may include the accompaniment output unit 101 which reads accompaniment data corresponding to a song musical piece specified by the singer and outputs an accompaniment sound from the sound output unit 25 via the signal processing unit 21.

The second starting-point detection unit 113 in the technique determination function 100*a* detects, for the data indicating the pitch detected by the pitch detection unit 105, whether the pitch periodically varies as exceeding a predetermined width defined in advance. The second starting-point detection unit 113 specifies, when detecting periodical variation of the pitch, a period in which periodical variation of the pitch is detected as a pitch variation period and detects a starting point of the pitch variation period as a second starting point. The second starting-point detection unit 113 outputs the detected starting point to the technique determination unit 111*a*.

Figure 9:
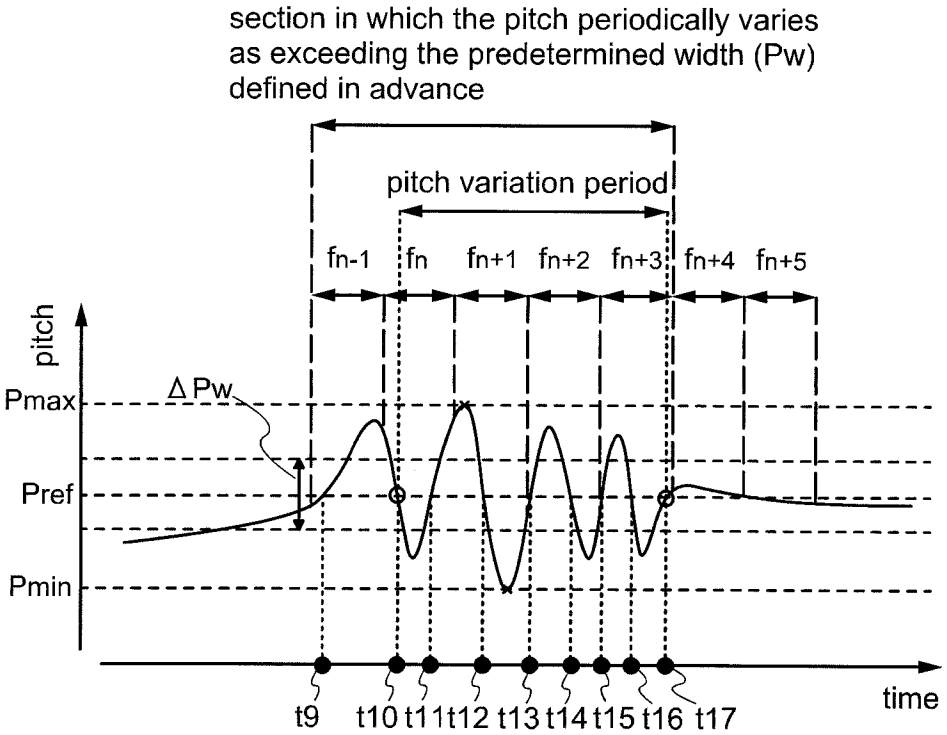
FIG. 9 is a diagram for describing a concept of detection of a second starting point in the modification example of one embodiment of the present invention.

FIG. 9 is a diagram for describing a concept of second starting-point detection in the second starting-point detection unit 113. FIG. 9 shows a pitch waveform indicating a pitch of a singing sound on a time-series basis, with the vertical axis representing pitch (P) and the horizontal axis representing time (T). The second starting-point detection unit 113 detects a section in which the pitch periodically varies as exceeding the predetermined width (ΔPw) defined in advance. By way of example, the second starting-point detection unit 113 determines, for the data indicating the pitch detected by the pitch detection unit 105 and for each frame (each of data samples sectioned by a predetermined period), whether variation of the pitch in each frame exceeds the predetermined width (ΔPw) defined in advance. When a predetermined number of frames or more (for example, two or more frames) in which variation of the pitch exceeds the predetermined width (ΔPw) defined in advance are detected, the second starting-point detection unit 113 detects the plurality of frames in which variation of the pitch exceeds the predetermined width (ΔPw) defined in advance as a section in which the pitch periodically varies as exceeding the predetermined width (ΔPw) defined in advance. In FIG. 9, frames $f_{n-1}$ to $f_{n+5}$ are shown. The length of a frame f is arbitrary. With reference to FIG. 9, the second starting-point detection unit 113 may detect the frames $f_{n-1}$ to $f_{n+3}$ as frames in which variation of the pitch exceeds the predetermined width (ΔPw) defined in advance and as a section in which the pitch periodically varies as exceeding the predetermined width (ΔPw) defined in advance.

Next, the second starting-point detection unit 113 detects a maximum value (Pmax) and a minimum value (Pmin) of the pitch in the section in which the pitch periodically varies as exceeding the predetermined width (ΔPw) defined in advance, and calculates an intermediate value between the maximum value (Pmax) and the minimum value (Pmin) as a reference value (Pref). Next, in the section in which the pitch periodically varies as exceeding the predetermined width (ΔPw) defined in advance, the second starting-point detection unit 113 detects a timing when the pitch matches the reference value (Pref). For example, in FIG. 9, times when the pitch has the reference value (Pref), that is, times t9 to t17, may be specified as timings when the pitch has the reference value (Pref). Next, the second starting-point detection unit 113 measures a time interval in which a timing when the pitch has the reference value (Pref) appears, and specifies a section in which (1) the measured time interval is within a range defined in advance, (2) a timing point when the pitch has the reference value (Pref) is continuously detected a predetermined number of times or more (for example, three times or more), and (3) the pitch periodically varies as exceeding the predetermined width (ΔPw) as a pitch variation period. As a starting point (second starting point) of the pitch variation period, a first timing on a time-series basis when the pitch has the reference value (Pref) in the pitch variation period is taken as a starting point (second starting point) of the pitch variation period. Also, as an ending point of the pitch variation period, a last timing on the time-series basis when the pitch has the reference value (Pref) in the pitch variation period is taken as an ending point of the pitch variation period. For example, in FIG. 9, a period from t10 to t17 is specified as the pitch variation period, the second starting period as a starting period of the pitch variation is t10, and the ending point of the pitch variation is t17. Note in FIG. 9 that an interval between t9 and t10 is not within the range defined in advance. The second starting-point detection unit 113 detects the starting point of the pitch variation as a second starting point in the above-described manner, and outputs data indicating the detected second starting point to the technique determination unit 111*a*.

Note that the method of detecting a pitch variation period described above is merely an example, and is not meant to be restrictive. As another example of the method of detecting a pitch variation period, for example, with reference to a guide melody with a variable pitch being 100 cents, a zero-cross point of data indicating a pitch (timing when the pitch changes from negative to positive or from positive to negative) may be detected, a time interval in which a zero-cross point appear may be measured, and a section in which (1) the measured time interval is within a range defined in advance, (2) a zero-cross point is continuously detected a predetermined number of times or more (for example, three times or more), and (3) the pitch periodically varies as exceeding the predetermined width (ΔPw) may be specified as a pitch variation period. In this case, as a starting point (second starting point) of the pitch variation period, in a section in which the pitch exceeds the predetermined width (ΔPw) defined in advance, a time point within a period defined in advance from a time point of a first pitch peak (the amplitude of the pitch becomes maximum with reference to 0 cent) on the time-series basis and when a first zero cross appears on the time-series basis may be taken as a starting point (second starting point) of the pitch variation period. Also, as an ending point of the pitch variation period, in a section in which the pitch exceeds the predetermined width (ΔPw) defined in advance, a time point within a period defined in advance from a time point of a last pitch peak (the amplitude of the pitch becomes maximum with reference to 0 cent) on the time-series basis and when a last zero cross appears on the time-series basis may be taken as an ending point of the pitch variation period.

The technique determination unit 111*a* determines a technique of the singing voice based on the change of the sound volume after the first starting point (starting point of sound-volume change) detected by the first starting-point detection unit 109*a* and variation of the pitch after the first starting point. In particular, when the technique determination unit 111*a* determines vibration and down (Nuki) as a singing technique, in addition to the change of the sound volume after the first starting point and the variation of the pitch after the first starting point, the technique determination unit 111*a* uses the second starting point (starting point of variation of the pitch) detected by the second starting-point detection unit 113. In the following, vibration and down (Nuki) determination by the technique determination unit 111*a* is described. Note that determination of vibrator, decrescendo, and crescendo by the technique determination unit 111*a* is similar to that by the technique determination unit 111 and therefore their description is omitted.

Figure 10:
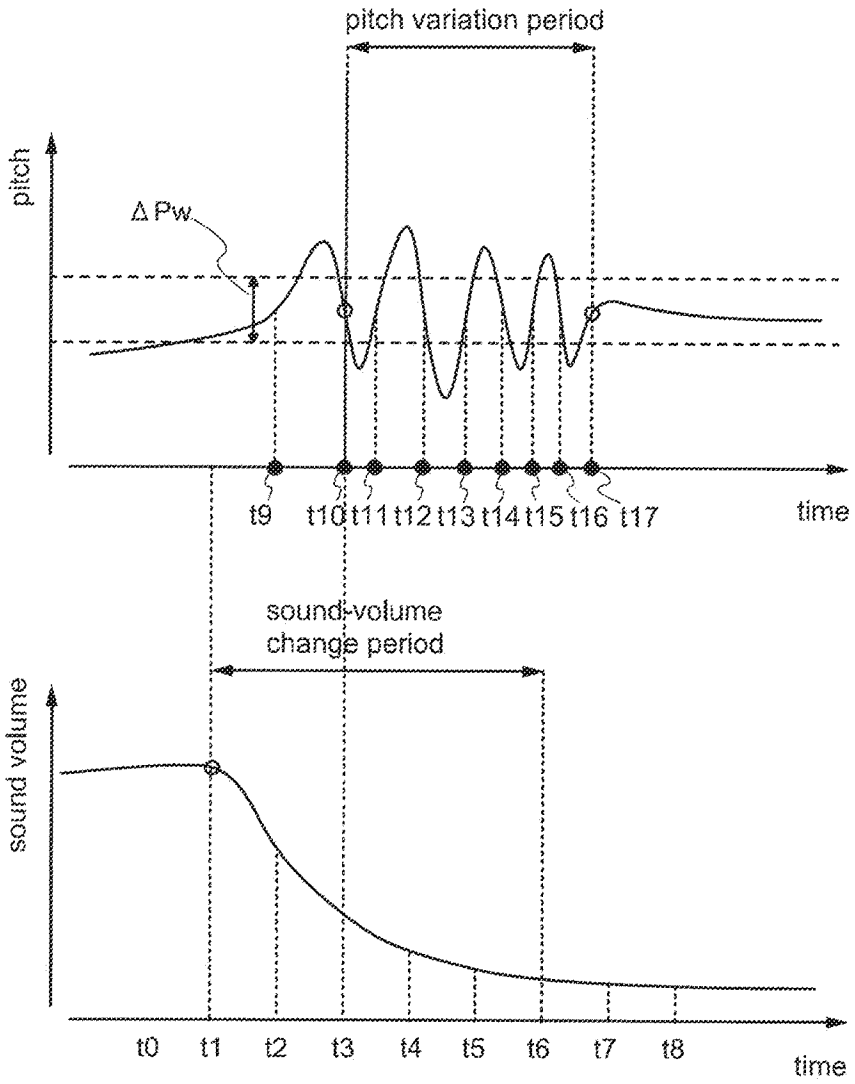
FIG. 10 is a diagram for describing a concept of vibration and down determination in the modification example of one embodiment of the present invention.

FIG. 10 shows diagrams for describing a concept of vibration and down (Nuki) determination executed by the technique determination unit 111. FIG. 10 shows one example of a pitch waveform and one example of a sound volume waveform of a singing sound. In the pitch waveform FIG. 10, the vertical axis represents pitch (P), and the horizontal axis represents time (T). In the sound volume waveform FIG. 10, the vertical axis represents sound volume (V), and the horizontal axis represents time (T). In FIG. 10, the pitch waveform and the sound volume waveform in the same period are shown on a time-series basis. In FIG. 10, a second starting point (starting point of variation of the pitch) detected by the second starting-point detection unit 113 is taken as t10, and a period from t10 to t17 is taken as a pitch variation period. Also in FIG. 10, a first starting point (starting point of sound-volume change) detected by the first starting-point detection unit 109*a* is taken as t1, and a sound-volume change period from t1 to t6 is taken. In this example, t10 in the pitch waveform is assumed to match t3 in the sound volume waveform.

As shown in FIG. 10, when the sound volume after the first starting point t1 decreases, the pitch vertically vibrates as exceeding a predetermined width (in this case, ΔPw) defined in advance after the first starting point t1, and the first starting point t1 and the second starting point t10 is within a range of a predetermined period, the technique determination unit 111*a* determines that vibration and down (Nuki) is included in the singing sound after the first starting point t1. That is, when vibration and down (Nuki) included in the singing sound is determined, if the pitch vertically vibrates as exceeding the predetermined width ΔPw defined in advance during a decrease of the sound volume after the first starting point t1, that is, in the sound-volume change period (period from t1 to t6) and the second starting point (t10=t3) is within a predetermined time interval from the first starting point (t1), it can be determined that vibration and down (Nuki) is included in the singing sound after the first starting point t1.

In this manner, when vibration and down (Nuki) in the singing sound is determined, in addition to a change of the sound volume after the starting point (first starting point) of the sound-volume change and variation of the pitch after the starting point of the sound-volume change, the starting point (second starting point) of variation of the pitch is used, thereby further improving accuracy of vibration and down (Nuki) determination.

In the foregoing, the example has been described in which when the pitch vertically vibrates as exceeding the predetermined width (ΔPw) defined in advance in the sound-volume change period and the difference between the first starting point (starting point of sound-volume change) and the second starting point (starting point of variation of the pitch) is within the range of the predetermined period, the technique determination unit 111 determines that vibration and down (Nuki) is included in the singing sound in the sound-volume change period. However, the present invention is not limited to this example. For example, as described with reference to FIG. 4, when at least a predetermined partial period in the sound-volume change period after the first starting point (starting point of sound-volume change) is defined as a detection section, the pitch vertically vibrates as exceeding the predetermined width (ΔPw) defined in advance in the detection section, and the difference between the starting point of the detection period and the second starting point (starting point of variation of the pitch) is within the range of the predetermined period, the technique determination unit 111 may determine that vibration and down (Nuki) is included in the singing sound after the first starting point t1.

In the above-described technique determination functions 100 and 100*a*, the sound indicated by the singing voice data acquired by the input sound acquisition unit 103 is not limited to a voice by the singer, but may be a voice by singing synthesis or a musical instrument sound. When the sound is a musical instrument sound, a single-sound musical performance is preferable. Note that when the sound is a musical instrument sound, the concept of consonants and vowels is not present but there is a tendency similar to that of singing at a starting point of sound emission of each sound depending on the musical performance method. Therefore, similar determination may be possible even in the case of a musical instrument sound.

Those obtained by addition, deletion, or design change of a component or by addition, omission, or condition change of a process made as appropriate by people skilled in the art based in the structures described as the embodiments of the present invention and including the gist of the present invention are also included in the scope of the present invention.

Also, even other operations and effects that are different from operations and effects brought by the modes of the above-described embodiment but are evident from the description of the present specification and can be easily predicted by people skilled in the art are also construed as being naturally brought by the present invention.

What is claimed is:

1. A technique determination device comprising:

an input sound acquisition unit acquiring an input sound;

a pitch detection unit detecting a pitch on a time-series basis based on the input sound acquired by the input sound acquisition unit;

a sound-volume detection unit detecting a sound volume on the time series basis based on the input sound acquired by the input sound acquisition unit;

a first starting-point detection unit determining whether variation of the sound volume detected by the sound-volume detection unit is equal to or larger than a predetermined threshold for each predetermined period and detecting a starting point of a period in which the variation of the sound volume is equal to or larger than the threshold as a first starting point; and a technique determination unit determining a technique of the input sound based on a change of the sound volume after the first starting point detected by the first starting-point detection unit and variation of the pitch after the first starting point.

2. The technique determination device according to claim 1, wherein the technique determination unit determines the technique based on a correlation between the variation of the sound volume and the variation of the pitch.

3. The technique determination device according to claim 2, wherein the starting-point detection unit identifies a plurality of consecutive predetermined periods in which variation of the sound volume is equal to or larger than the predetermined threshold as a sound-volume change period, and the first starting point is a starting point of the sound-volume change period.

4. The technique determination device according to claim 3, wherein the technique determination unit determines the technique based on variation of the pitch in the sound-volume change period after the first starting point.

5. The technique determination device according to claim 4, wherein the technique determination unit determines vibration and down is included in the sound-volume change period after the first starting point when vibration of the pitch exceeding a predetermined width is included in the sound-volume change period after the first starting point.

6. The technique determination device according to claim 2, wherein the technique determination unit determines vibrato is included in a period in which the pitch periodically varies as exceeding a predetermined width when the first starting point is not identified by the starting-point detection unit and the pitch periodically varies as exceeding the predetermined width.

7. The technique determination device according to claim 4, wherein the technique determination unit determines decrescendo is included in the sound-volume change period after the first starting point when the sound volume in the sound-volume change after the first starting point t1 decreases and periodical variation of the pitch exceeding a predetermined width is not present in the sound-volume change period after the first starting point.

8. The technique determination device according to claim 4, wherein the technique determination unit determines crescendo is included in the sound-volume change period after the first starting point when the sound volume in the sound-volume change after the first starting point t1 increases and periodical variation of the pitch exceeding a predetermined width is not present in the sound-volume change period after the first starting point.

9. The technique determination device according to claim 1, further comprising a second starting-point detection unit detecting, as a second starting point, a starting point of a pitch variation period in which the pitch detected by the pitch detection unit periodically varies as exceeding a predetermined width, wherein the technique determination unit determines the technique based on the first starting point and the second starting point.

10. The technique determination device according to claim 9, wherein the technique determination unit determines the technique based on a correlation between the variation of the sound volume and the variation of the pitch.

11. The technique determination device according to claim 10, wherein the starting-point detection unit identifies a plurality of consecutive predetermined periods in which variation of the sound volume is equal to or larger than the predetermined threshold as a sound-volume change period, and the first starting point is a starting point of the sound-volume change period.

12. The technique determination device according to claim 11, wherein the technique determination unit determines vibration and down is included in the sound-volume change period after the first starting point when the difference between the first starting point and the second starting point is within the range of the predetermined period and vibration of the pitch exceeding the predetermined width is included in the sound-volume change period after the first starting point.

13. The technique determination device according to claim 1, further comprising an evaluation unit calculating an evaluation value for the input sound based on the technique determined by the technique determination unit.

14. The technique determination device according to claim 13, further comprising a comparison unit comparing the technique determined by the technique determination unit with a reference technique data corresponding to the input sound, wherein the evaluation unit calculates the evaluation value for the input sound based on a comparison result by the comparison unit.

15. A technique determination method comprising:

acquiring an input sound;

detecting a pitch on a time-series basis based on the input sound;

detecting a sound volume on the time series basis based on the input sound;

determining whether variation of the detected sound volume is equal to or larger than a predetermined threshold for each predetermined period and detecting a starting point of a period in which the variation of the sound volume is equal to or larger than the threshold as a first starting point; and determining a technique of the input sound based on a change of the sound volume after the detected first starting point and variation of the pitch after the first starting point.

16. The technique determination method according to claim 15, wherein determining the technique of the input sound includes determining the technique of the input sound based on a correlation between the variation of the sound volume and the variation of the pitch.

17. The technique determination method according to claim 16, wherein detecting the first starting point includes identifying a plurality of consecutive the predetermined periods in which variation of the sound volume is equal to or larger than the predetermined threshold as a sound-volume change period, and the first starting point is a starting point of the sound-volume change period.

18. The technique determination method according to claim 17, wherein determining the technique of the input sound includes determining the technique based on variation of the pitch in the sound-volume change period after the first starting point.

19. The technique determination method according to claim 15, further comprising detecting, as a second starting point, a starting point of a pitch variation period in which the pitch periodically varies as exceeding a predetermined width, wherein determining the technique of the input sound includes determining the technique based on the first starting point and the second starting point.

20. The technique determination method according to claim 15, further comprising calculating an evaluation value for the input sound based on the technique.

* * * * *